United States Patent [19]

Klar et al.

[11] Patent Number: 4,769,071

[45] Date of Patent: Sep. 6, 1988

[54] TWO-STEP INFILTRATION IN A SINGLE FURNACE RUN

[75] Inventors: Erhard Klar, Beachwood; Mark Svilar, University Heights, both of Ohio

[73] Assignee: SCM Metal Products, Inc, Cleveland, Ohio

[21] Appl. No.: 88,078

[22] Filed: Aug. 21, 1987

[51] Int. Cl.[4] ..... B22F 3/00

[52] U.S. Cl. ..... 75/246; 75/247; 419/53; 419/54; 419/57; 419/58; 419/60; 419/27; 419/29

[58] Field of Search ..... 419/53, 54, 57, 58, 419/27, 60, 29; 75/246, 247

[56] References Cited

U.S. PATENT DOCUMENTS

| | | | |
|---|---|---|---|
| 2,606,831 | 8/1952 | Koehring | 419/27 |
| 2,778,742 | 1/1957 | Shipe | 419/27 |
| 2,783,145 | 2/1957 | Boyce | 419/27 |
| 3,411,902 | 11/1968 | Krock et al. | 419/54 |
| 3,674,472 | 7/1972 | Kimura et al. | 419/54 |
| 4,123,265 | 10/1978 | Takahashi et al. | 419/27 |
| 4,606,768 | 8/1986 | Svilar et al. | 75/246 |

*Primary Examiner*—Stephen J. Lechert, Jr.
*Attorney, Agent, or Firm*—Lieberman, Rudolph & Nowak

[57] ABSTRACT

There is provided a process for infiltrating a compacted ferrous powder metal body with copper or a copper alloy which process is characterized by presintering the ferrous metal body at a temperature of from about 1875° F. to a temperature below the melting point of the infiltrant, and then in the same furnace, raising the temperature above the melting point of the copper or copper alloy infiltrant for a period sufficient to infiltrate the powder metal body. This process is more economical than the prior double run infiltration processes and provides excellent impact strengths and tensile strengths.

29 Claims, No Drawings

TWO-STEP INFILTRATION IN A SINGLE FURNACE RUN

This invention relates, as indicated, to an improved infiltration procedure for ferrous bodies formed of a powdered iron. Infiltration of the ferrous bodies with copper or a copper alloy improves the mechanical properties of the ferrous bodies, especially the Charpy impact strength and the tensile strength.

RELATED PATENTS AND APPLICATIONS

This application is related to commonly owned U.S. Pat. No. 4,606,768 dated Aug. 19, 1986 to Svilar et al and to our copending application Ser. No. 935,854 filed Nov. 28, 1986. These references are incorporated herein by reference thereto.

BACKGROUND OF THE INVENTION AND PRIOR ART

Conventional ferrous powder metal bodies, or parts, produced by simple pressing and sintering, are known to have rather inferior mechanical properties; e.g., impact and fatigue strength, because of the presence of pores in such bodies. Methods for overcoming these inferior properties are based upon achieving full or nearly full density. One method for obtaining nearly full density is to infiltrate the bodies with copper or a copper alloy, a process which has been in common practice since the 1940's.

Inspite of the ability to achieve substantially full density by infiltration with a suitable infiltrant, only a small improvement in dynamic properties has been achieved over uninfiltrated ferrous powder bodies.

The impact strength of ferrous powder metal parts is important for many applications, e.g., gears wherein a critical region is at the root of the gear teeth with weakness at that point leading to gear failure; and in hammers for use in hammer type mill wherein a critical area is the area between the head and the shank. Imperfection in this area can lead to failure.

A conventional method for determining impact strength of specimens in the Charpy impact test procedure is described in the Metal Powder Industries Federation (MPIF) Standard 40, 1974 Metal Powder Industries Federation P.O. Box 2054, Princeton, N.J. 08540. In this test, unnotched specimens are formed into a defined rectangular shape having specified dimensions and are placed in a pendulum-type impact machine with a capacity of at least 110 foot pounds (15.2 m-kg). The impact strength is the average of three tests reported to the nearest foot pound. Standard 40 is incorporated herein by reference thereto. For purposes of the present application, the term impact strength, where used, shall mean unless otherwise noted, the strength values obtained following the Charpy-type test procedure outlined in Standard 40.

Another mechanical property of interest in the preparation of many ferrous powder metal parts is the tensile strength. This property, and the test for determining it, are described in MPIF Standard 10, also incorporated herein by reference thereto. An aspect of the tensile strength of a powder metal part is the elongation of the part that occurs prior to failure. In the present application, the tensile strength and elongation shall be given (unless otherwise stated) in terms of kips per square inch (ksi or thousands of pounds per square inch) and percent elongation (E%), respectively, following the procedure of Standard 10.

Parts made according to state of the art powder metallurgy technology, i.e., pressed and sintered or infiltrated, have very low impact strengths—typically only 3 to 20 ft. lbs measured by the unnotched Charpy Test. Higher impact strength would enable these low cost methods to be used for higher performance parts that are now made by alternative technologies that are more expensive, i.e., powder metal forging, hot pressing, injection molding, etc.

Copper in iron is known to enable the iron to precipitation harden. Iron also can be hardened by adding carbon and heat treating. The use of carbon and heat treatment is least expensive and virtually the most common way the strengh and toughness of steel is improved.

Prior patent application Ser. No. 755,282 filed July 15, 1985, now U.S. Pat. No. 4,606,768 dated Aug. 19, 1986, assigned to assignee of the present application, describes how to improve significantly impact strength of copper infiltrated steel by assuring the absence of erosion and local porosity (defined statistically in terms of pore volume and maximum pore size). Unnotched Charpy impact strengths as high as 130 ft. lbs at an ultimate tensile strength of 103 ksi have been obtained. Combinations of high impact and high ultimate tensile strength are sought in many engineering applications. The disclosure of U.S. Pat. No. 4,606,768 is incorporated by reference herein.

State of the art copper infiltration of iron and steel parts uses long infiltration times to ensure the most complete infiltration possible and improve tensile strength. Typically, the times range from 30 minutes to 90 minutes, although shorter infiltration times have been reported. For these times there is partial alloying of the copper with the iron due to dissolving and reprecipitation of the iron because of liquid phase sintering as well as solid state diffusion of the copper into the iron. In the areas where copper and iron are both present, optimizing heat treatment for impact toughness is complicated by both carbon and copper hardening mechanisms operating at the same time.

Several investigators (see U.S. Pat. No. 4,606,768) have attempted to obtain higher combinations of impact strength and tensile strength. Some of these investigators (i.e., Kuroki et al in 1973, Impact Properties of Copper Infiltrated Sintered Iron; Journal Japan Society Powder Metallurgy, July, 1973, Vol. 20., pages 71–79) have employed short infiltration times but were unable to obtain the desirable and large improvements reported herein.

In application Ser. No. 935,854, supra, the applicants found that it was possible to obtain even better combinations of impact strength and tensile strength by controlling the microstructure of the infiltrated steel in such a way that the diffusion of copper into the steel matrix is kept within a certain range. Control of the cleanliness of the steel matrix affords an additional improvement. Through combination of the improvements of the U.S. Pat. No. 4,606,768 and those disclosed in Ser. No. 935,854 it was possible to obtain impact strengths (unnotched Charpy) of over 240 ft. pounds, and ultimate tensile strengths of over 100 ksi. Also, with the improvement of Ser. No. 935,854, it was found possible to obtain unnotched Charpy impact strengths of 50 ft. pounds at a tensile strength of over 100 ksi at a low overall density of about 7.55 g/cm$^3$. At such low overall density, conventional processing typically gives an unnotched Chapy impact strength of less than 20 ft. lbs.

The invention of Ser. No. 935,854 also provides an infiltrated ferrous powder metal body infiltrated with copper or a copper alloy characterized as having after infiltration an overall density of at least 7.5 g/cm$^3$ and a diffusion depth of copper into the steel matrix of less than about 4 micrometers as determined by chemical etching or less than about 8 micrometers as determined by electron dispersive X-ray analysis (EDXA).

An important aspect of the invention of Ser. No. 935,854 conducive to staying within the diffusion depth parameters stated above is employing as the powder metal an iron powder having a carbon content in the range of about 0.3 to about 1.4%, based on the weight of the copper-free iron skeleton. The percent carbon is the amount by weight added to the iron powder for preparing a so-called "green part". During sintering and infiltrating, a portion of this carbon is lost due to the formation of carbon oxides, the oxygen content of the iron powder being the source of the oxygen. Carbon may also be lost through the formation of hydrocarbons with any hydrogen used in the sintering atmosphere. Typical losses amount to about 0.1 to 0.2% based on the copper-free steel skeleton.

In U.S. Pat. No. 4,606,768 as well as Ser. No. 935,854, we have taught how to obtain excellent combinations of impact and tensile strengths by various infiltration processes that produce specific structures. Examples in Ser. No. 935,854 show that a "two-step" process (sintering followed by infiltrating) gave properties significantly better than the "single-step" (sintering and infiltrating performed simultaneously) process. For example, Examples 13 and 15 in Ser. No. 935,854 gave impact strengths of 64 and 90 ft. lbs. and tensile strengths 100 to 110 ksi whereas two-step processing gave impact strengths of 200 ft lbs. or more at similar tensile strengths.

In this application, for purposes of clarity, reference will henceforth be made to "single run" and "double run" to indicate whether one or two separate furnace operations are used. The term "step" will be reserved to indicate whether one or more distinct temperature plateaus are used in any individual furnace run.

BRIEF STATEMENT OF THE INVENTION

Briefly, stated, the present invention is in a process for infiltrating a compacted ferrous powder metal body, compacted to a density of at least about 70% of theoretical density, with copper or a copper alloy at an infiltrating slug-to-metal matrix ratio of from 14% to about 55% by weight, said powder metal body after infiltration having a carbon content of from about 0.15% to about 1.25% by weight, and an infiltrated density of from about 7.5 g/cm$^3$ to about 8.2 g/cm$^3$, the improvement which comprises the steps, carried out in a single furnace run, of presintering the ferrous powder metal body at a temperature of from about 1875° F., to below the melting point of the infiltrant for a period of from about 5 to about 60 minutes, and then infiltrating the presintered body with copper or a copper alloy by raising the temperature in said furnace to a temperature above the melting point of the copper or copper alloy infiltrant for a period of from about 5 to about 90 minutes. This procedure results in a substantial reduction in cost and the attainment of similar or better Charpy impact values and tensile strength properties.

DETAILED DESCRIPTION OF THE INVENTION AND SPECIFIC EXAMPLES

Conventional double run infiltration consists of sintering the powder metal (ferrous) matrix in a furnace at a temperature of about 2050° F. to 2150° F. and then infiltrating during a second furnace run. Sintering the ferrous powder body before infiltration produces an only slightly stronger body because of the stronger bonding of the iron particles. Thus, this double run process of sintering and then infiltrating has been virtually replaced by a single, single step or "sintration" process because of reduced cost and similarity of properties achieved by the two processes. In the ordinary single run infiltration, the ferrous powder body is infiltrated without prior high temperature sintering.

The applicants have found a means for improving the impact strength of single run and double run infiltrated parts. Single run "sintrated" parts in the past gave unnotched Charpy impact strengths of 60 to 90 ft. lbs., while double run infiltrated parts have impact strengths greater than 240 ft. lbs. There is thus a clear incentive to use the more expensive double run process.

As indicated above, the applicants have now found that infiltration can be made less costly by sintering and infiltrating in a two-step single furnace run. This can be achieved by sintering the matrix below the melting point of the infiltrant to form strong bonds between the ferrous particles, and then, without removing the part from the furnace, raising the temperature in such furnace to the infiltrating temperature. Although the bonds between the matrix particles do not form as readily because the sintering temperature used is lower than typical, surprisingly high impact values were found when this invention was used in connection with high performance infiltration technology.

Further improvements in the process are obtained by adding sintering agents, e.g., boron and phosphorus, to the matrix material in amounts ranging from about 0.01% to about 0.1% by weight, which have the effect of enabling more complete sintering at temperatures below about 1875° F. Also, better results are achieved by adjusting the composition of the infiltrating alloy so that the infiltrating temperature can be raised to allow for more complete sintering to occur.

Residual porosity after infiltration and maximum pore size of the uninfiltrated pores is an important aspect in attaining high impact strength. A powder metal iron or steel part infiltrated with a copper or copper alloy desirably has, after infiltration an overall density of at least 7.5 g/cm$^3$, a residual uninfiltrated porosity of less than about 10% by volume, and a maximum pore size of the uninfiltrated pores of less than about 120 micrometers, wherein both values are taken from a worst field of view of a functionally critical area. Within these parameters, Charpy impact strengths greater than 50 foot pounds and a high ultimate tensile strength of more than 49,000 pounds per square inch are obtained. These values are obtained in the as-infiltrated condition prior to any heat treatment.

For purposes of the present invention, the critical area is defined as that area adjacent a fractured surface of an infiltrated part subjected to failure obtained by clean cutting-off the fractured surface and polishing the cut area. The worst field of view is obtained by viewing and analyzing a plurality of views of the cut polished surface. In the present invention, 50 fields of view are analyzed to obtain a worst field of view. Residual uninfiltrated porosity and maximum pore size data is obtained by measurement under magnification. The volume percent porosity is obtained from the area measurement following a procedure outlined in pages 446–449 of the National Bureau of Standards Publication 431, dated January 1976 (incorporated herein by reference thereto). Preferably, the worst field of view has a porosity less than about 5 percent and a maximum pore size of residual uninfiltrated porosity of less than about 75 micrometers.

Also, for purposes of the present application, the term "powder metal iron or steel" includes as starting materials plain carbon steels, e.g., SAE 1025, tool steels, e.g., M2, stainless steels, e.g., 316L(AISI), and low alloy steels such as 4600. Typical alloying elements may be nickel, molybdenum, chromium, silicon and boron. Tool steels may contain such elements as vanadium and tungsten. The carbon content may be augmented as described below.

Also, in a preferred embodiment the infiltrant is copper, containing typically an alloying constituent such as iron, tin, zinc, silver, lithium, silicon, manganese, chromium, zirconium, and combinations thereof in amounts generally less than 5% by weight and preferably from 0.1% to 3%. The amount of any iron should be less than 2.0 to 3.0% by weight.

It is also desirable for best results to control the microstructure of the infiltrated ferrous powder metal body in such a way that the diffusion of copper into the iron matrix is kept within a certain range. Control of the cleanliness of the ferrous metal matrix provides additional improvement. As above indicated, the ferrous powder metal body infiltrated with copper or a copper alloy is desirably characterized as having after infiltration an overall density of about 7.5 g/cm$^3$ and a diffusion depth of copper into the ferrous powder metal matrix of less than about 4 micrometers as determined by chemical etching, or less than about 8 micrometers as determined by electron dispersive X-ray analysis (EDXA).

Preferably, the ferrous powder metal body has a diffusion depth of copper or copper alloy of less than about 3 micrometers as determined by chemical etching or less than about 5 micrometers as determined by EDXA.

An important aspect in the present invention conducive to staying within the diffusion depth parameters stated above is employing as the powdered metal an iron powder having a carbon content in the range of about 0.3 to about 1.4%, based on the weight of the copper-free skeleton. The percent carbon is the amount (weight percent) of carbon added to the iron powder for preparing a so-called green part or body. During presintering and infiltrating a portion of this carbon is lost due to the formation carbon monoxide and/or carbon dioxide (carbon oxides), the oxygen content of the iron powder being the source of oxygen. Carbon may also be lost through the formation of hydrocarbons with any hydrogen in the presintering and infiltrating atmosphere. Typical losses due to these causes amount to from 0.1% to 0.2%, or an average of 0.15% based upon the copper-free iron or steel skeleton.

In the Examples herein, the percent carbon, for the purpose of convenience, is generally expressed in terms of percent carbon (or graphite) added. Accordingly, in terms of combined carbon, i.e., the carbon concentration of the finished part based on the amount of the steel matrix only the critical range is between about 0.15 percent and about 1.25%. A preferred range is about 0.25% to about 1.05%. It is understood that the percent carbon added can be in the form of carbon (as graphite) blended in with the iron powder or carbon alloyed with the iron.

Although we desire not to be bound by a particular theory, it is believed that these percents carbon inhibit the diffusion of the copper into the ferrous metal particles during infiltration, and in so inhibiting diffusion, more than offset the negative aspect of the addition of carbon on impact strength. Optimum results are obtained with an added carbon content of about 0.9%.

As an alternative to carbon, or in combination with carbon, one can employ about 0.1% to about 0.2% of an additive such as boron, which will inhibit diffusion in the same manner as carbon.

The "diffusion depth" of copper is determined by measuring the copper concentration at various depths, for instance one, two or three micrometers, and plotting the copper concentration data against depth data on semi-logarithmic paper.

The copper concentration is plotted along the linear scale starting from zero, and the depth is plotted along the logarithmic scale starting from zero. The connection of the experimental points forms approximately a straight line and the "diffusion depth" is the point of intersection of the straight line with the logarithmic scale at zero percent copper concentration.

In those cases where the iron or steel contains prior to infiltration, a more or less uniformly distributed base amount of copper, (a base concentration, for instance about several percent copper, can be tolerated) the same procedure for determining diffusion depth is employed, except that only the experimental points close to the surface of the steel particle are used to form said straight line. A new base line is then drawn parallel to the logarithmic scale at the level of the base amount of copper, and then the point of intersection obtained by extrapolation of the straight line with the new base line establishes the "diffusion depth".

The following specific examples are illustrative of the present invention and will enable those skilled in the art to prepare yet other examples utilizing the teachings of these examples.

EXAMPLE I

Izod impact specimens made of A1000SP iron powder, 0.9%, Lonza 25 graphite and 0.75% zinc stearate as a lubricant were pressed to 7.04 g/cm$^3$ density. An IP204LD infiltrant slug weighing 14% of the green specimen was placed on one end of the specimen. The sample specimens were sintered and infiltrated in a vacuum furnace with the following temperature profile:

Heat to 1400° F. and hold for 10 minutes.
Heat to 1900° F. and hold for 60 minutes.
Heat to 2050° F. and hold to 7 minutes.

The process of the present invention is desirably carried out in an inactive furnace atmosphere, including vacuum. The pressure may range from near vacuum to atmospheric or above. Useful furnace atmospheres include, vacuum, helium, argon, dissociated ammonia, "synthetic nitrogen", nitrogen, hydrogen, carbon monoxide, or mixtures of two or more thereof, etc. "Synthetic nitrogen" is formed by thermal decomposition of methanol in the presence of variable amounts of nitrogen. Dissociated ammonia is formed by the thermal decomposition of ammonia and yields a gas containing nitrogen, hydrogen and possibly traces of ammonia.

The dew point of the atmosphere used should be less than about 35° F. although dew points as high as 60° F. may be used. When nitrogen is present in the atmosphere used, there is some tendency to react with the iron to form nitrides. However, this has been found to be very slight and thus insignificant to the results obtained. Also, when carbon monoxide and carbon dioxide are present in the gas mixture, the quantities of each should be thermodynamically balanced and take into account the carbon content of the powdered metal. A preponderance of carbon dioxide can cause oxidation of deleterious amounts of iron, whereas an excess of carbon monoxide can cause reduction to carbon and effect perhaps harmful change in the carbon content. If, however, these gases are thermodynamically balanced in the system the deleterious tendencies are cancelled out and the gas remains relatively inert.

The specimens were then austenitized at 1650° F. for 15 minutes and tempered at 1300° F. for 60 minutes. The specimens were then shortened to the proper length for Charpy unnotched impact strength testing. The results for two bars were 107 and 124 ft-lbs. respectively. These results fall between the single and double run processes.

A1000SP has the following analysis:

Carbon 0.01%
Sulfur 0.15%
$H_2$ loss 0.17%
Oxygen 0.12%
Nitrogen 0.0014%
Phosphorus 0.006%
Silicon 0.01%
Manganese 0.16%
Copper 0.04%
Nickel 0.04%
Chromium 0.04%

A typical analysis of the infiltrant material IP-204LD is as follows:

Iron 2–3%
Manganese 0.5–1.5%
Lubricant 0.5–1.0%
Other 0.5–1.0%
Copper Balance.

Instead of zinc stearate, any thermally decomposable lubricant for aiding the compacting operation may be used. Another example is Acrawax C (Chemical Abstracts Reg. No. 110-30-5) or N,N'-1,2-ethanediylbisoctadecanamide.

EXAMPLE II

Samples were prepared as in Example I above and the sintering and infiltration were performed sequentially in a single furnace run. In order to obtain better control of temperature and time, the experiments were performed in a vacuum furnace using distinct temperature/time profiles. In this set of experiments, the vacuum furnace was operated under a helium pressure of about 300 micrometers of Hg. The heat up rates from room temperature to 1900° F. and from 1900° F. to 2050° F. were 100° F. per minute and 50° F. per minute, respectively. The holding times at 1900° F. and 2050° F. as well as the impact properties (after austenitizing, water quenching and tempering at 1200° F. for 1 hour) are shown in the following Table I.

TABLE I

| Impact Bar No. | Presintering Temperature °F. | Pre-sintering Time Minutes. | Infil. Temp. °F. | Infilt. Time Min. | Charpy Impact Strength ft. lbs. |
|---|---|---|---|---|---|
| II-1 | 1900 | 0 | 2050 | 7 | 98 |
| II-2 | 1900 | 0 | 2050 | 7 | 150 |
| II-3 | 1900 | 0 | 2050 | 7 | 98 |
| II-4 | 1900 | 30 | 2050 | 7 | 160 |
| II-5 | 1900 | 30 | 2050 | 7 | 162 |
| II-6 | 1900 | 30 | 2050 | 7 | 228 |
| II-7 | 1900 | 30 | 2050 | 10 | 142 |
| II-8 | 1900 | 30 | 2050 | 10 | 142 |
| II-9 | 1900 | 30 | 2050 | 10 | 142 |
| II-10 | 1900 | 60 | 2050 | 7 | 187 |
| II-11 | 1900 | 60 | 2050 | 7 | 120 |
| II-12 | 1900 | 60 | 2050 | 7 | 206 |

The infiltrated densities were between 7.78 g/cm$^3$ and 7.90 g/cm$^3$. The specimens showed no sign of erosion when viewed under a low magnification stereo-microscope. The tensile strengths of these specimens are about 100 to 110 ksi. It is clear from these properties that it is now possible to obtain excellent, never before possible combinations of impact an tensile strength with single run processing. Even with zero presintering time at the lower temperature, unnotched Charpy impact strengths were between about 100 to 150 ft. lbs. At 30 minutes presintering the average impact strength to about 162 ft. lbs. and individual values were as high as 228 ft. lbs. The benficial effect of presintering at a temperature below the melting point of the infiltrant is attributed to the formation of a stronger matrix skeleton.

EXAMPLE III

Samples were prepared and processed as in Example I except that the vacuum furnace was pressurized with nitrogen to a pressure of about 750 mm Hg, that is nearly atmospheric pressure, for both the presintering and infiltration steps. Also, presintering time was 30 minutes and infiltration time was 14 minutes instead of the 7 and 10 min of Example I. The impact strengths are shown in the following Table II.

TABLE II

| Impact Bar No. | Unnotched Charpy Impact Strength Ft. Lbs. |
|---|---|
| III-1 | 121 |
| III-2 | 72 |
| III-3 | 107 |

The infiltrated densities of these specimens were between 7.80 and 7.85 g/cm$^3$. Although the impact strengths of this example were lower than those of Example I for the same length of presintering, this example demonstrates that attractive strength properties are obtainable also when sintering and infiltration during a single furnace run are performed in an atmosphere such as nitrogen.

EXAMPLE IV

Samples were prepared and processed as in Example I except that the single Furnace run operation was carried out in a laboratory tube furnace using an atmosphere of nitrogen and hydrogen, obtained from cylinders in a volume ratio of 1 to 3, that is corresponding in analysis to that of dissociated ammonia. The impact strengths are shown in the following Table III:

TABLE III

| Impact Bar No. | Presintering Temperature °F. | Pre-sintering Time Minutes. | Infil. Temp. °F. | Infilt. Time Min. | Charpy Impact Strength ft. lbs. |
|---|---|---|---|---|---|
| IV-1 | 1900 | 0 | 2050 | 10 | 111 |
| IV-2 | 1900 | 0 | 2050 | 10 | 121 |
| IV-3 | 1900 | 0 | 2050 | 10 | 146 |
| IV-4 | 1900 | 30 | 2050 | 10 | 238 |
| IV-5 | 1900 | 30 | 2050 | 10 | 119 |
| IV-6 | 1900 | 30 | 2050 | 10 | 93 |
| IV-7(1) | 1900 | 30 | 2050 | 10 | 123 |
| IV-8(1) | 1900 | 30 | 2050 | 10 | 175 |
| IV-9(1) | 1900 | 30 | 2050 | 10 | 149 |
| IV-10 | 1900 | 60 | 2050 | 10 | 104 |
| IV-11 | 1900 | 60 | 2050 | 10 | 188 |
| IV-12 | 1900 | 60 | 2050 | 10 | 133 |

(1)The slug-to-metal matrix ratio for these three specimens had been increased to 0.21.

The densities of the infiltrated specimens varied between 7.75 and 7.89 g/cm$^3$. The overall results are similar to those shown in Example I demonstrating that excellent properties for single run furnace processing are also possible when the furnace atmosphere is a reducing one.

EXAMPLE V

Samples were prepared and processed as in Example I except that the single furnace run operation was carried out in a laboratory tube furnace using an atmosphere of nitrogen and hydrogen, obtained from cylinders in a volume ratio of 1 to 3, that is corresponding to that of dissociated ammonia. The impact strengths are shown in the following Table IV:

TABLE IV

| Impact Bar No. | Presintering Temperature °F. | Unnotched Charpy Impact Strength Ft. Lbs. |
|---|---|---|
| V-1 | 1875 | 178 |
| V-2 | 1875 | 181 |
| V-3 | 1875 | 188 |
| V-4 | 1900 | 180 |
| V-5 | 1900 | 125 |
| V-6 | 1900 | 184 |
| V-7 | 1925 | 238 |
| V-8 | 1925 | 137 |
| V-9 | 1925 | 185 |
| V-10 | 1950 | 216 |
| V-11 | 1950 | 183 |
| V-12 | 1950 | 171 |

The infiltrated densities of these specimens varied between 7.88 and 7.90 g/cm$^3$. This series of experiments demonstrates that it is possible to obtain excellent impact strength using single furnace run processing over a relatively narrow range of presintering temperatures above about 1875° F.

What is claimed is:

1. In a process for infiltrating a compacted ferrous powder metal body compacted to a density of at least about 70% of theoretical density, with copper or a copper alloy at an infiltrating slug-to-metal ratio of from about 14% to about 55% by weight, said powder metal body after infiltration having a carbon content of from about 0.15% to about 1.25% by weight, based on the amount of ferrous metal and an infiltrated density of from about 7.5 g/cm$^3$ to about 8.2 g/cm$^3$, the improvement which comprises the steps, carried out in a single furnace run, of presintering the ferrous powder metal body at a temperature of from about 1875° F. to a temperature below the melting point of the infiltrant for a period of about 5 to about 60 minutes, and then infiltrating the presintered body with copper or copper alloy by raising the temperature of said body in said furnace to a temperature above the melting point of the copper or copper alloy infiltrant for a period of from about 5 to about 90 minutes.

2. A process as defined in claim 1 wherein the presintering temperature is in the range of from 1900° F. to 1950° F.

3. A process as defined in claim 1 wherein the presintering time is in the range of from about 7 minutes to about 30 minutes.

4. A process as defined in claim 1 wherein the furnace is elevated to a temperature of about 1400° F. for a period of time sufficient to remove any lubricant.

5. A process as defined in claim 4 wherein the period of time at about 1400° F. is about 10 minutes.

6. A process as defined in claim 1 wherein the presintering is carried out under vacuum.

7. A process as defined in claim 1 wherein the presintering temperature is about 1900° F. and the time over which the body is held at that temperature is about 60 minutes.

8. A process as defined in claim 1 wherein the infiltrating temperature is in the range of from 2050° F. to 2150° F.

9. A process as defined in claim 8 wherein the period of sintering is from about 7 to about 10 minutes.

10. A process as defined in claim 8 wherein the period of sintering is in the range of from 60 to 90 minutes.

11. A process as defined in claim 1 wherein the ferrous powder body is austenitized after infiltrating.

12. A process as defined in claim 11 wherein the ferrous powder body is austenitized at a temperature of 1650° F.

13. A process as defined in claim 11 wherein the ferrous powder body is tempered after austenitizing.

14. A process as defined in claim 13 where the ferrous powder body is tempered at a temperature of about 1200° F. to about 1300° F. for about 60 minutes.

15. A process as defined in claim 1 wherein the ferrous powder metal part infiltrated with copper or a copper alloy is characterized by an overall density of about 7.5 g/cm$^3$, and a diffusion depth of copper into the ferrous metal matrix of less than about 4 micrometers as determined by chemical etching or less than about 8 micrometers as determined by electron dispersive X-ray analysis.

16. A process as defined in claim 15 wherein said diffusion depth is less than about 3 micrometers as determined by chemical etching or less than about 5 micrometers as determined by electron dispersive X-ray analysis.

17. A process as defined in claim 1 wherein the ferrous powder metal body has an overall density of at least 7.5 g/cm$^3$, a residual uninfiltrated porosity of not more than 10 volume percent, and a maximum pore size of the residual uninfiltrated porosity of less than about 120 micrometers, said porosity and pore size values being taken from the worst field of view in a functionally critical area of said metal body.

18. A process in accordance with claim 1 wherein the infiltrant is copper alloyed with an alloying constituent selected from the group consisting of iron, tin, zinc, silver, lithium, silicon, manganese, chromium, zirconium, and mixtures or two or more of said metals.

19. A process as defined in claim 1 wherein the ferrous powder metal body is a low alloy or tool steel.

20. A process as defined in claim 19 wherein said ferrous metal has a boron content in the range of about 0.1% to 0.2%.

21. A process as defined in claim 1 wherein the presintering and infiltration is carried out in an inert gas atmosphere.

22. A process as defined in claim 21 wherein the furnace atmosphere contains hydrogen.

23. A process as defined in claim 22 wherein the furnace atmosphere is dissociated ammonia.

24. A process as defined in claim 22 wherein the gas atmosphere is hydrogen.

25. A process as defined in claim 21 wherein the furnace atmosphere is "synthetic" nitrogen.

26. A process as defined in claim 21 wherein the furnace atmosphere is selected from argon, helium, and nitrogen.

27. A product produced in accordance with the process of claim 1.

28. A product produced in accordance with the process of claim 15.

29. A product produced in accordance with the process of claim 17.

* * * * *